US006666250B2

(12) United States Patent
Eckelt

(10) Patent No.: US 6,666,250 B2
(45) Date of Patent: Dec. 23, 2003

(54) DEVICE FOR PRESSING THE ADHESIVE-GLUED AREAS OF CONTINUOUSLY CONVEYED, FLAT OBJECTS

(75) Inventor: Ulrich Eckelt, Tecklenburg (DE)

(73) Assignee: Windmoeller & Holescher, Lengerich (DE)

( * ) Notice: Subject to any disclaimer, the term of this patent is extended or adjusted under 35 U.S.C. 154(b) by 85 days.

(21) Appl. No.: 09/985,336

(22) Filed: Nov. 2, 2001

(65) Prior Publication Data

US 2002/0056524 A1 May 16, 2002

(30) Foreign Application Priority Data

Nov. 2, 2000 (DE) ..... 100 54 254

(51) Int. Cl.[7] ..... B30B 5/00
(52) U.S. Cl. ..... 156/555; 156/583.5
(58) Field of Search ..... 156/555, 582, 156/583.5; 493/186, 318, 319, 454

(56) References Cited

U.S. PATENT DOCUMENTS

| | | | | |
|---|---|---|---|---|
| 3,566,754 A | * | 3/1971 | Stork et al. | 93/8 |
| 3,583,296 A | * | 6/1971 | Stork et al. | 93/8 |
| 3,643,552 A | * | 2/1972 | Stork | 93/27 |
| 5,131,973 A | * | 7/1992 | Feldkamper | 156/555 |

FOREIGN PATENT DOCUMENTS

| | | |
|---|---|---|
| DE | 18 09 792 | 6/1969 |
| DE | 40 02 156 | 5/1991 |

* cited by examiner

*Primary Examiner*—James Sells
(74) *Attorney, Agent, or Firm*—Jacobson Holman PLLC

(57) ABSTRACT

A device for pressing the adhesive-glued areas of continuously conveyed, flat objects, preferably the bottoms of flat-laying bags. The device includes two dual belt conveyors running parallel to each other and mounted in a rack, and whose conveyor belts pressed against each other form pressing belts. To be able to quickly and easily adjust the pressing belts to a different position of glued areas to be pressed, at least one dual belt conveyor is mounted on a support or frame that is guided cross-sliding in the rack.

10 Claims, 3 Drawing Sheets

DEVICE FOR PRESSING THE ADHESIVE-GLUED AREAS OF CONTINUOUSLY CONVEYED, FLAT OBJECTS

FIELD OF THE INVENTION

The invention relates to a device for pressing the adhesive-glued areas of continuously conveyed, flat objects, preferably the bottoms of flat-laying bags, by two dual belt conveyors running parallel to each other and mounted in a rack, and whose conveyor belts pressed against each other form pressing belts.

BACKGROUND OF THE INVENTION

For example, in the production of bags from tubular sections of single or multiple layered paper, bottoms are tip-stretched onto both tubular section ends and, after the tubular section ends are drawn open, the bottoms are joined by overlapping folding and applying a glue layer and are closed by gluing a bottom cover sheet, if necessary after inserting a tubular valve. The bottoms are molded onto the tubular section ends while passing through a so-called bottom-laying station and are provided with layers of glue in the areas to be glued together. Before the bags produced in this way can be stacked or loaded onto palettes, the glued points have to set. For this purpose, the bags conveyed cross-laying pass through pressing stations in which pressing belts pressed against each other ensure good adhesive connections by pressing of the glued areas. Typical bottom-layers are designed such that they allow bottoms to be molded onto different size tubular sections in order to produce bags of different formats. According to the differently produced formats of the bags, in the pressing station downstream from the bottom-layer station the pressing belts' distances must also be adjusted to the bottoms to be pressed. This arrangement, if at all possible, is typically connected with a costly conversion effort.

The technical problem of the invention is thus to create a device of the kind indicated in the beginning, in which the pressing belts can be quickly and easily adjusted to the glued areas to be pressed.

SUMMARY OF THE INVENTION

According to the invention, this technical problem is solved in that at least one dual belt conveyor is mounted on a support or frame that is guided cross-sliding in the rack.

The device according to the invention makes it possible to easily and quickly adjust the distance between the pressing belts to the glued areas to be pressed by simple sliding of at least one support or frame bearing a dual belt conveyor. As a rule, it should be sufficient to adjust only one frame bearing a dual belt conveyor, because the position of a bottom of a flat-laying bag is not changed and in case of a change in format, only the other bottom changes its distance.

According to a preferred form of construction, it is provided for that sliding blocks or slides are guided sliding on crossheads of the rack and bearing the support or frame with the dual belt conveyor.

The frame is usefully equipped with a drive for its parallel displacement, in such a way that the adjustment to different formats can be carried out by accordingly programmed control mechanisms.

The drive preferably consists of two spindles crossing the frame and on which spindle nuts are placed, and the spindles or spindle nuts mounted on the frame are equipped with synchronous drives.

According to a preferred form of construction, it is provided for that two spindles fixed on the rack cross the support or frame and spindle nuts mounted on the frame are driven by a continuous chain or belt drive via a gear motor.

In some cases it may be necessary for the other frame bearing the dual belt conveyor to be guided cross-sliding in the rack.

It is useful for this frame bearing the other dual belt conveyor to be detachably locked with the rack to be able to move it if necessary.

If the two frames bearing the dual belt conveyors are brought as closely together as possible, it may be necessary to still align them relative to the bags passing through, so that the pressing belts grasp in a favorable manner the glued bottoms to be pressed. The frame bearing the other dual belt conveyor is therefore preferably able—after releasing the detachable locking—to be connected with the first frame brought near it, such that both frames can be run through the drive together.

According to a preferred form of construction, it is provided that the locking consists of at least one two-arm lever mounted on the slide of the second frame with, at the lever's ends, claws, one of which grips a bore or a notch of the guide of the slide, and that the lever is equipped with a swivel drive that swivels the lever to connect it to the first frame in such a way that while the first claw is released, the other claw grips into a bore or notch of the slide or a connecting part of the other frame. The drive swiveling the lever usefully consists of a pneumatic cylinder.

BRIEF DESCRIPTION OF THE DRAWINGS

An example of execution of the invention is explained in greater detail with the help of the drawings. They show.

DETAILED DESCRIPTION OF THE PREFERRED EMBODIMENTS

Figure 1:
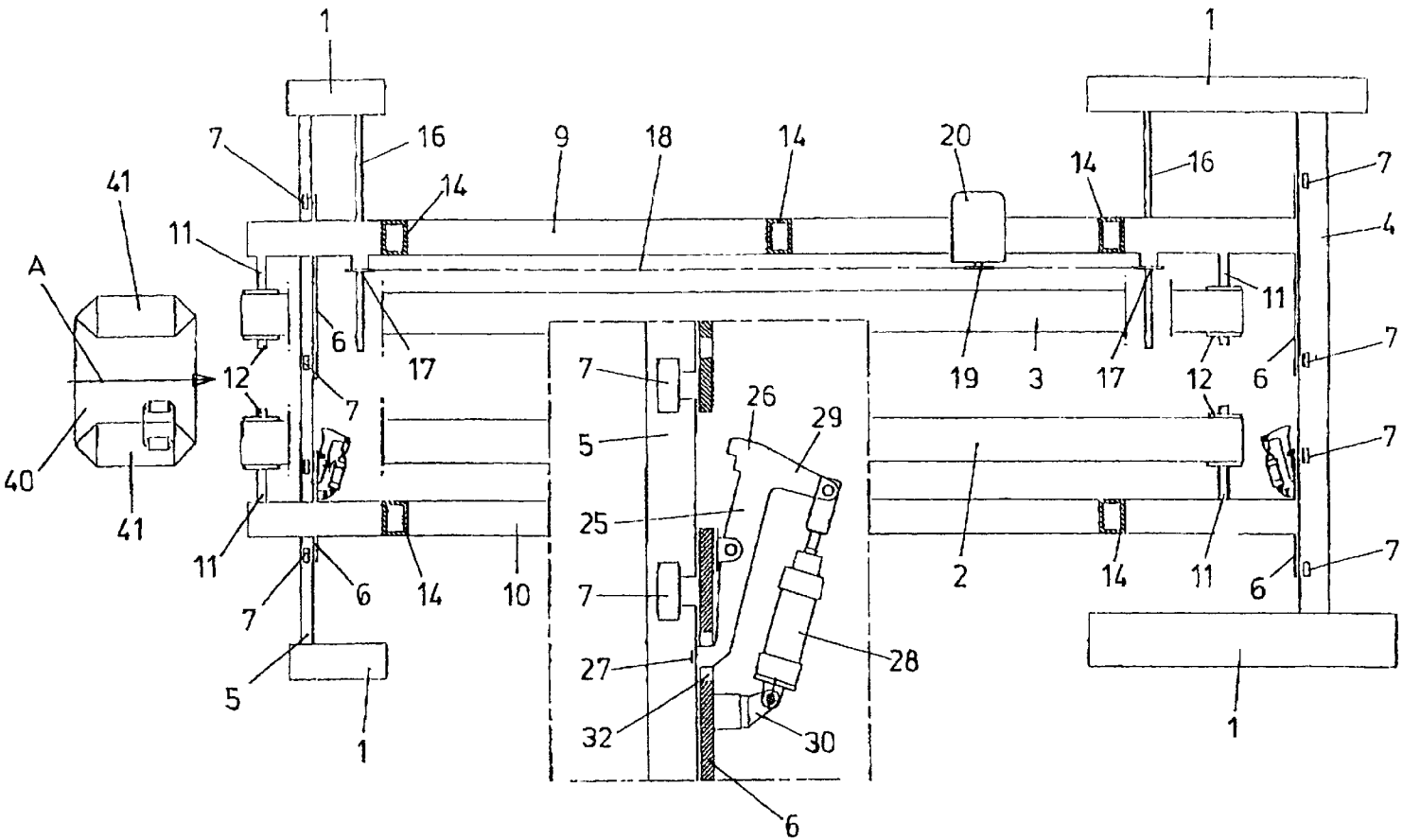
FIG. 1 a top view, in schematic diagram form, of the pressing device with the pressing belts spread far apart.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The device for pressing the bottoms molded in a bottom-layer station onto crosswise conveyed tubular sections, glued, joined, provided with bottom cover sheets and then folded into the plane of the side walls lying one on the other, consists of a machine housing, only the side parts 1 of which are shown in the drawing and in which the pairs of continuous pressing belts 2, 3 designed as dual belt conveyors are mounted. The front and rear parts 1 or sections of the side parts are linked by crossheads 4, 5. These crossheads 4, 5, which can consist of box girders or other beams, are guided on lengthwise sliding slides 6. The slides 6 consist of frames or plates equipped with track rollers 7 that run on the top of the beams forming the crossheads 4, 5. At least one more track roller can be additionally mounted on each plate and run on the bottom of the beam. The plates or frames of the slides 6 on one side are each connected together by longitudinal beams 9, 10. Attached at the end areas of the longitudinal beams 9, 10 are axle ends running parallel to the crossheads 4, 5, on which deflection rollers 12 are mounted, via which the lower continuous pressing belts run. Other longitudinal beams not illustrated are connected with the longitudinal beams 9, 10 via vertical columns 14; they run parallel to the lower longitudinal beams 9, 10 and are designed in roughly mirror-inverted manner compared to them. The upper continuous pressing belts are mounted accordingly on axle ends on the upper longitudinal beams. At least one of the two continuous pressing belt pairs in each case is equipped with a driven deflection roller.

On the frame parts 1 situated on top in the drawing, a threaded spindle 16 is attached parallel to each crosshead; a spindle nut is screwed onto it; the spindle nut is mounted on the longitudinal beam 9 able to rotate but immobile in axial direction. Each spindle nut is connected—resistant to torsion—with a sprocket wheel 17 over which a continuous chain 18 runs that can be driven in both directions by the sprocket wheel 19 of a gear motor 20 that is mounted on the longitudinal beam 9. Via the gear motor 20, the support 9 can thus be driven via the spindle drive on the crossheads 4, 5 in such a way that it is brought closer to or away from the other longitudinal beam 10.

Figure 2:
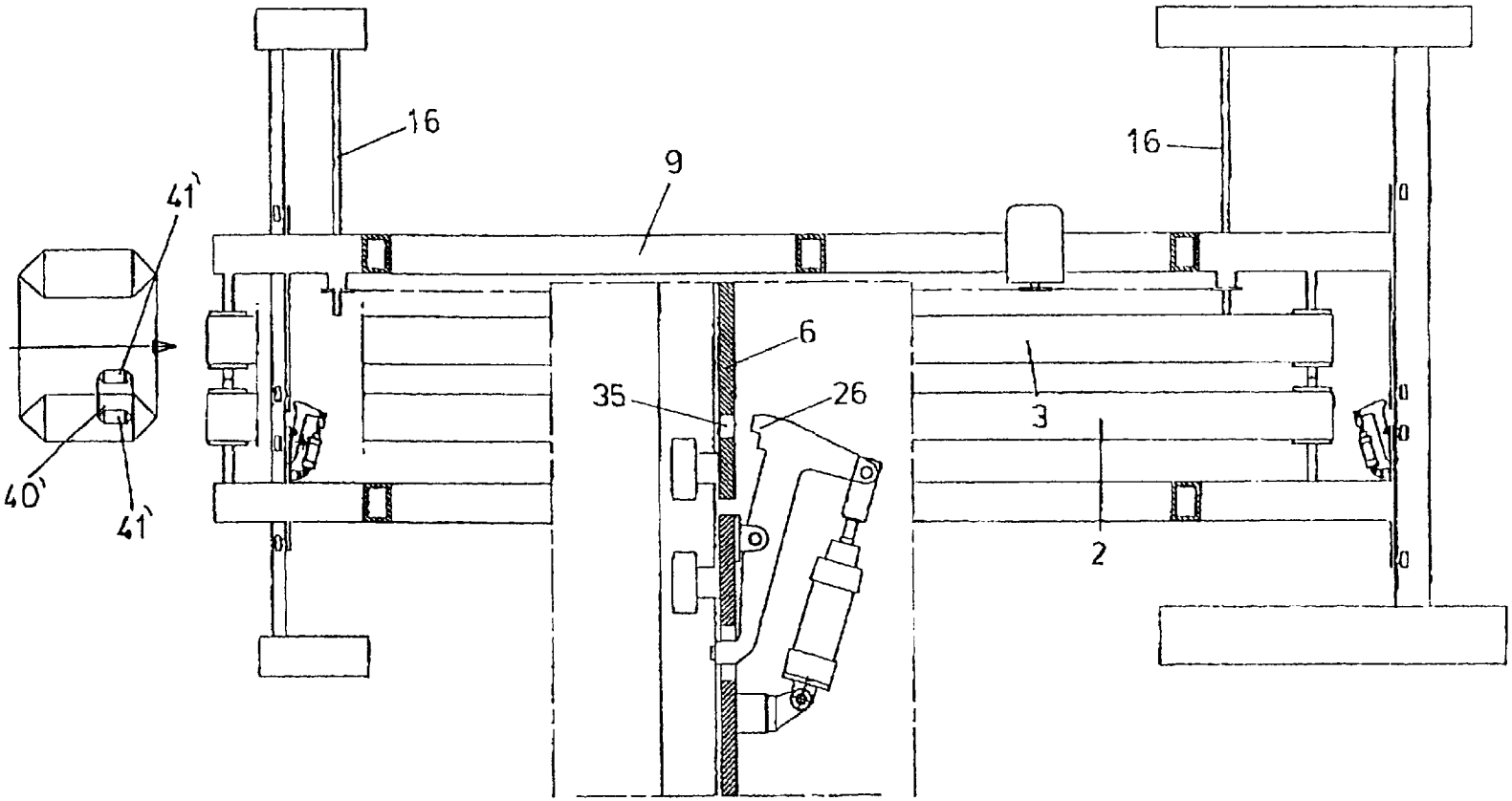
FIG. 2 the pressing belts of the device according to FIG. 1 drawn together and FIG. 3 a view corresponding to FIG. 2, in which the slides bearing the two pressing belts are locked together and are adjusted to bags passing through with the smallest format.

As can be seen from the enlarged views inserted in the middle areas of the figures, mounted swiveling on the frames or plates of the slides 6 of the lower longitudinal beam 10 is a two-arm lever 25 equipped with claws 26, 27 at its ends. The two-arm lever 25 is able to swivel in the illustrated manner by means of a pneumatic cylinder 28 whose piston rod is mounted swiveling on a bend 29 of the two-arm lever 25 and whose cylinder is mounted swiveling on a bracket 30 connected with the slide 6. If the bottoms of larger bags are pressed when passing through the pressing belts 2, 3, the pressing belts 2 shown in the lower part in the drawings are locked together with the crossheads 4, 5 in that the claws 27 of the two-arm lever 25 reach through recesses 32 of the plates of the slides 6 and snap into the notches of the crossheads 4, 5, in such a way that the longitudinal beam 10 is locked together with the pressing belt 2 opposite the crossheads. If the pressing device is adjusted to the format of the smallest bags to be pressed, the upper longitudinal beam 9 with the upper pressing belts are moved via the spindle drive as shown by FIG. 2 close against the lower pressing belts 2. In this close position, in which the upper and lower slides 6 butt against each other by stops, for example, the slides are then locked together in that the two-arm lever 25 is swung by the pneumatic cylinder 28 in such a way that the claws 27 are lifted from their notches in the crossheads 4, 5 and the claws 26 dip into notches 35 of the plates of the upper slides 6. In this way, the slides are locked together on both sides such that via the gear motor 6 and the spindle drive 16, the longitudinal beams 9, 10 can be moved, together with pressing belts mounted on them, back and forth in the machine housing.

Figure 3:
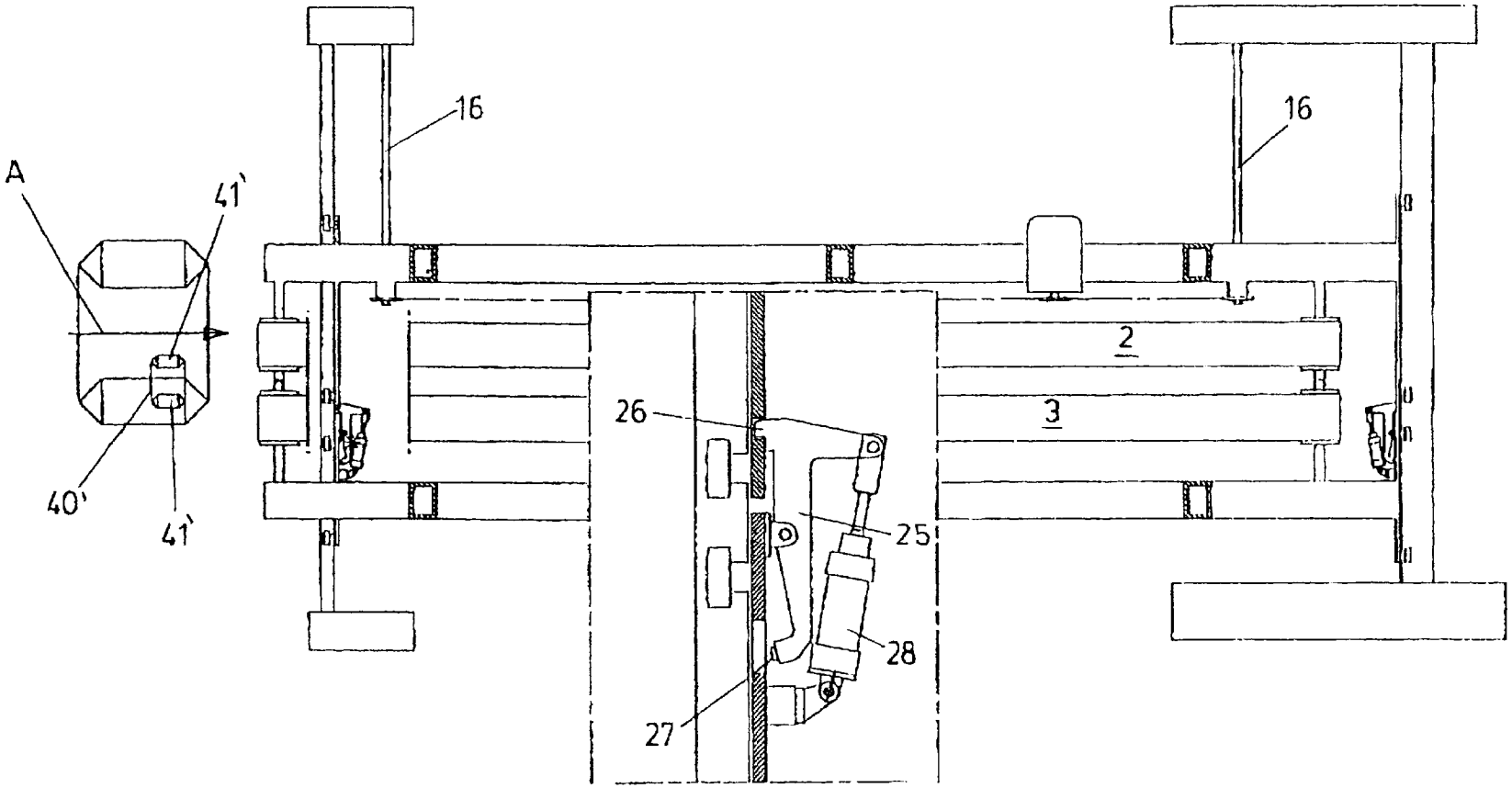

In FIG. 1, the pressing device is adjusted to the format of the bag 40 entering in the direction of the arrow A in such a way that its bottoms 41 enter the entrance gap between the pressing belts 2, 3. If the format of the bags to be pressed is changed, the pressing belts are adapted accordingly by moving the upper pressing belt pair. In the drawings, the smallest format of the bags 40' to be pressed is shown with the bottoms 41'. As FIG. 2 shows, the pressing belts 2, 3 are not properly adjusted for the bottoms 41' of the bags 40' when these are drawn together when the lower pressing belt is in fixed position. However, if the pressing belts are locked together in their mutual positions by the swivel lever 25 as shown in FIG. 3, the pressing belts 2, 3 interlocking can be adjusted by the spindle drive 16 for the bags 40' with the smallest format in such a way that the bottoms to be pressed enter the entrance gap of the pressing belts 2, 3 and are completely covered by them.

The conveyors bringing the bags are of a known kind and are thus not illustrated. In addition, the conveyors that receive the bags emerging from the pressing belts and carry them to be stacked or loaded on palettes are not shown, either.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. Device for pressing adhesive-glued areas of continuously conveyed, flat objects, said device comprising two dual belt conveyors running parallel to each other and mounted in a rack, and having conveyor belts pressed against each other to form pressing belts, at least one dual belt conveyor being mounted on a support or frame that is guided for cross-sliding in the rack.

2. Device according to claim 1, wherein sliding blocks or slides are guided for cross-sliding on crossheads of the rack and bear the support or frame with the dual belt conveyor.

3. Device according to claim 1, wherein the support or frame is provided in a drive for parallel displacement of the support or frame.

4. Device according to claim 3, wherein the drive consists of two spindles crossing the frame and on which spindle nuts are placed, and the spindles or spindle nuts mounted on the fame are equipped with synchronous drives.

5. Device according to claim 1, wherein two spindles fixed on the rack cross the support or frame and spindle nuts mounted on the support or frame are driven via a gear motor and a continuous chain or belt drive.

6. Device according to claim 1, wherein a support or frame for another dual belt conveyor is also guided for cross-sliding in the rack.

7. Device according to claim 6, wherein the support or frame for the other dual belt conveyor is detachably locked with the rack.

8. Device according to claim 7, wherein after releasing the detachable locking, the support or frame for the at least one dual conveyor is run through a drive.

9. Device according to claim 7, wherein the locking is produced from at least one two-arm lever mounted on a slide, the at least one two-arm lever includes claws, one of which grips a bore or a notch of a guide of a slide, and the lever is equipped with a swivel drive that swivels the lever to connect the lever to the support or frame in such a way that while the first claw is released, the other claw grips into a bore or recess of the slide or a connecting part of the support or frame.

10. Device according to claim 9, wherein the swivel drive consists of a pneumatic cylinder.

* * * * *